US010081986B2

(12) United States Patent
Stewart

(10) Patent No.: US 10,081,986 B2
(45) Date of Patent: Sep. 25, 2018

(54) SUBSEA CASING TIEBACK

(71) Applicant: Ensco International Incorporated, Wilmington, DE (US)

(72) Inventor: Christopher Scott Stewart, Cornelius, NC (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 15/070,863

(22) Filed: Mar. 15, 2016

(65) Prior Publication Data

US 2017/0198531 A1 Jul. 13, 2017

Related U.S. Application Data

(60) Provisional application No. 62/276,065, filed on Jan. 7, 2016.

(51) Int. Cl.

| | |
|---|---|
| ***E21B 17/02*** | (2006.01) |
| ***E21B 17/01*** | (2006.01) |
| ***E21B 43/013*** | (2006.01) |
| ***E21B 33/035*** | (2006.01) |
| ***E21B 33/038*** | (2006.01) |
| ***E21B 33/064*** | (2006.01) |

(52) U.S. Cl.

CPC ..... *E21B 17/02* (2013.01); *E21B 17/01* (2013.01); *E21B 33/035* (2013.01); *E21B 33/038* (2013.01); *E21B 33/064* (2013.01); *E21B 43/013* (2013.01)

(58) Field of Classification Search

CPC ..... E21B 17/02; E21B 17/01; E21B 43/013

USPC ..... 166/359

See application file for complete search history.

(56) References Cited

U.S. PATENT DOCUMENTS

| | | | | |
|---|---|---|---|---|
| 4,653,589 | A | 3/1987 | Alandy | |
| 5,255,746 | A * | 10/1993 | Bridges | 166/348 |
| 6,273,193 | B1 | 8/2001 | Hermann et al. | |
| 6,540,024 | B2 * | 4/2003 | Pallini | E21B 33/038 166/347 |
| 7,503,391 | B2 | 3/2009 | McCanna et al. | |
| 7,621,241 | B2 | 11/2009 | Gecim | |
| 8,127,853 | B2 | 3/2012 | Pallini et al. | |
| 9,085,951 | B2 | 7/2015 | Kotrla et al. | |
| 2002/0074124 | A1 | 6/2002 | Cunningham et al. | |
| 2003/0056954 | A1 | 3/2003 | Headworth | |
| 2004/0074649 | A1 | 4/2004 | Hatton et al. | |

(Continued)

OTHER PUBLICATIONS

Padelopoulos et al., "Top Tensioned Riser (TTR) Engineering Integrator Supply Model," 2H Offshore Inc., 2012; 16 pgs.

(Continued)

*Primary Examiner* — Matthew R Buck
*Assistant Examiner* — Patrick F Lambe
(74) *Attorney, Agent, or Firm* — Fletcher Yoder, P.C.

(57) ABSTRACT

Techniques and systems to couple a high pressure casing string to a blowout preventer or a subsea shut-in device. A device includes a locking mechanism configured to interface with a terminal end of a casing string of an offshore platform to couple the device to the terminal end of the casing string. The device also includes a sealing mechanism configured to fluidly seal an area around the terminal end of the casing string, wherein the locking mechanism and the sealing mechanism are disposed at separate positions along a vertical orientation of the device.

21 Claims, 7 Drawing Sheets

(56) References Cited

U.S. PATENT DOCUMENTS

| | | | | |
|---|---|---|---|---|
| 2006/0196673 | A1 | 9/2006 | Pallini, Jr. et al. | |
| 2006/0278406 | A1 | 12/2006 | Judge et al. | |
| 2008/0135289 | A1 | 6/2008 | Ford | |
| 2012/0085544 | A1* | 4/2012 | Shilling | E21B 17/015 166/345 |
| 2012/0211236 | A1 | 8/2012 | Braithwaite | |
| 2013/0048295 | A1 | 2/2013 | Beynet et al. | |
| 2013/0087342 | A1 | 4/2013 | Shotton et al. | |
| 2013/0230358 | A1 | 9/2013 | Cain et al. | |
| 2014/0010597 | A1 | 1/2014 | Otten et al. | |
| 2014/0027124 | A1 | 1/2014 | Cain et al. | |
| 2015/0122503 | A1 | 5/2015 | Shilling et al. | |

OTHER PUBLICATIONS

Stell, "Subsea tiebacks: The latest strategies," OE Digital; Apr. 1, 2013; 8 pgs.

Subsea Tie-Back Systems; DrilQuip; 2014; 12 pgs.

PCT International Application No. PCT/US2017/012337 International Search Report and Written Opinion dated Apr. 20, 2017, 16 pgs.

* cited by examiner

SUBSEA CASING TIEBACK

CROSS REFERENCE TO RELATED APPLICATIONS

This application is a Non-Provisional Application claiming priority to U.S. Provisional Patent Application No. 62/276,065, entitled "Subsea Casing Tieback", filed Jan. 7, 2016, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. However, as wells are drilled at increasing depths, additional components may be utilized to, for example, control and or maintain pressure at the wellbore (e.g., the hole that forms the well) and/or to prevent or direct the flow of fluids into and out of the wellbore. One component that may be utilized to accomplish this control and/or direction of fluids into and out of the wellbore is a blowout preventer (BOP). BOPs may include subsea BOPs or surface BOPs that operate in conjunction with a subsea shut-in device (SID) to perform drilling operations.

During well construction, the first shallow larger diameter hole sections that are formed generally have a lower pore pressure relative to deeper hole sections. This allows a riser connecting the well to a surface BOP to be rated to a lower pressure. However, as the vertical depth of the well increases, the bore pressure may increase such that the pressure may overcome the rating of the riser which connects the well to the surface BOP. Accordingly, the ability to tieback a well (i.e., tieback a higher pressure riser within the lower pressure riser) with increased depth is desirable.

DETAILED DESCRIPTION

Figure 1:
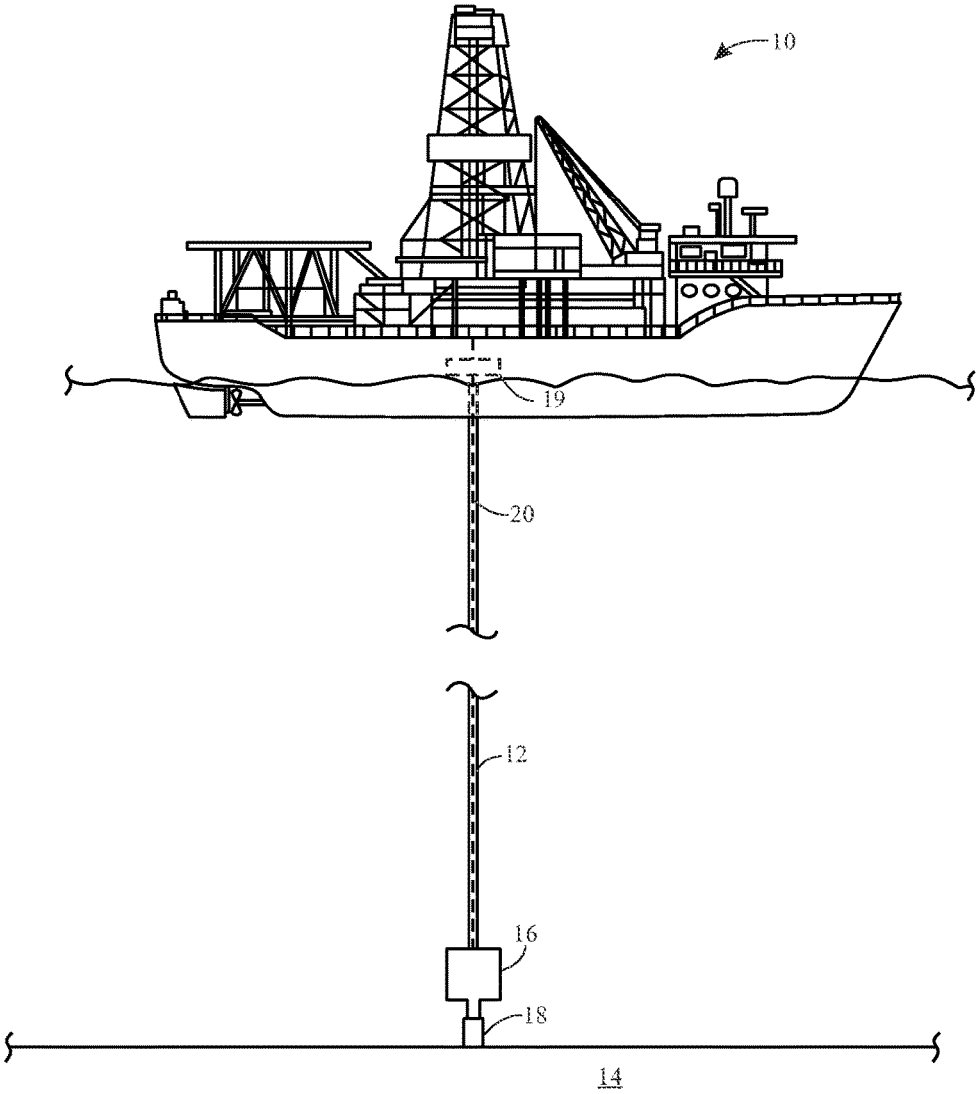
FIG. 1 illustrates an example of an offshore platform having a riser coupled to a shut-in device (SID).

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Devices and techniques for connecting a casing tieback to a surface blowout preventer (BOP) are set forth below. Bore pressures increase as the depth of a well increases. Thus, low pressure risers that may be generally utilized with relatively shallow wells may need to be replaced or supplemented to accommodate the increase in the bore pressures. One technique for accommodating the higher pressures is to retrieve the lower pressure riser and replace it with a higher pressure riser. However, this technique has the burden of additional cost and time to perform such an operation. Another technique may include utilizing a tieback casing that extends internally along the lower pressure (and larger) outer riser from the subsea wellhead to the surface BOP. However, utilizing this technique would typically involve placing the high pressure casing (e.g., an unshearable or highly difficult to shear connection) across a subsea shut-in device (SID). A third technique may implemented that does not suffer from the cost and time for low pressure riser replacement while still allowing for shearing and/or other containment to be accomplished in the SID.

The third technique discussed above may include systems and methods for tying back a high pressure casing string from above the SID to a surface BOP and or to a wellhead. A tieback connector may be positioned at an upper point of the high pressure casing string such that the tieback connector connects the surface BOP to the high pressure casing string. Additionally or alternatively, a tieback connector may be positioned at a lower point of the high pressure casing string, such that the tieback connector connects the SID to the high pressure casing string. Use of one or more tieback connectors in this fashion may allow for advantages inclusive of a reduction in the weight and the thickness of the primary outer riser (e.g., the low pressure riser string) while allowing the system to accommodate higher well pressures, since higher pressure fluids can be routed between the wellhead and a platform via the high pressure casing in place of a thicker and/or heavier outer riser. Additionally, use of the tieback connector(s) may allow for the high pressure casing string to be co-located with the low pressure string (e.g., internal to the low pressure string) so that additional time and efforts to separately remove a low pressure string and replace it with a high pressure string may be avoided. Moreover, the tieback connector(s) may include locking mechanisms that are physically separate and distinct from sealing mechanisms of the tieback connector(s) so as to reduce wear on the sealing mechanisms that might otherwise occur if the sealing mechanisms were also operating as a locking mechanism of the tieback connector(s). Additionally, these locking mechanisms may put the internal casing and/or riser in tension and the locking mechanism may apply tension to the internal casing or allow the internal casing to hang freely.

With the foregoing in mind, FIG. 1 illustrates an offshore platform comprising a drillship 10. Although the presently illustrated embodiment of an offshore platform is a drillship 10 (e.g., a ship equipped with a drilling system and engaged in offshore oil and gas exploration and/or well maintenance or completion work including, but not limited to, casing and tubing installation, subsea tree installations, and well capping), other offshore platforms such as a semi-submersible platform, a spar platform, a floating production system, or the like may be substituted for the drillship 10. Indeed, while the techniques and systems described below are described in conjunction with drillship 10, the techniques and systems are intended to cover at least the additional offshore platforms described above.

As illustrated in FIG. 1, the drillship 10 includes a riser string 12 extending therefrom. The riser string 12 may include a pipe or a series of pipes that connect the drillship 10 to the seafloor 14 via, for example, a SID 16 that is coupled to a wellhead 18 on the seafloor 14 and a surface BOP 19. In some embodiments, the riser string 12 may transport produced hydrocarbons and/or production materials between the drillship 10 and the wellhead 18, while the SID 16 may include at least one valve with a sealing element to control wellbore fluid flows. In some embodiments, the riser string 12 may pass through an opening (e.g., a moonpool) in the drillship 10 and may be coupled to drilling equipment of the drillship 10 or the riser string 12 may terminate at the BOP 19. As illustrated in FIG. 1, it may be desirable to have the riser string 12 positioned in a vertical orientation between the wellhead 18 and the drillship 10 to allow a drill string made up of drill pipes 20 to pass from the drillship 10 through the SID 16 and the wellhead 18 and into a wellbore below the wellhead 18.

Figure 2:
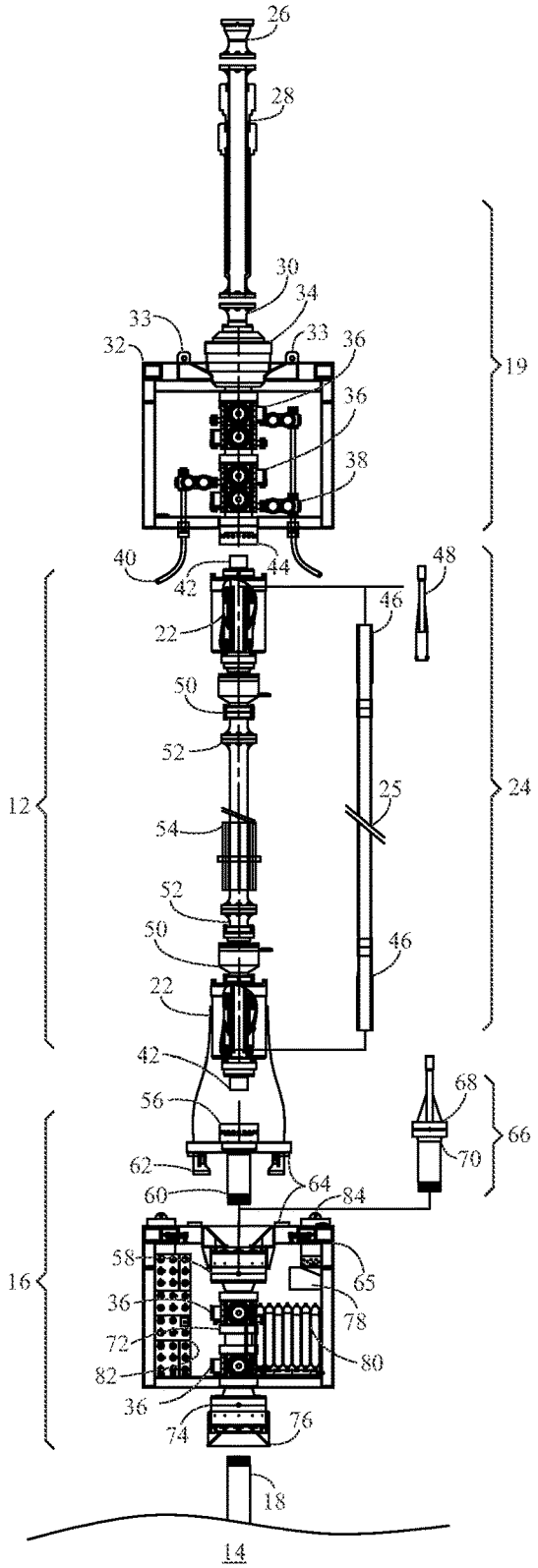
FIG. 2 illustrates a side view of a tieback connector in relation to the riser string and the SID of FIG. 1.

FIG. 2 illustrates a side view of the BOP 19, the riser string 12 (e.g., a low pressure riser string), and the SID 16. Also illustrated are tieback connectors 22 that may be utilized to couple a high pressure casing string 24 (e.g., high pressure resistant piping made up of pipe segments 25) to each of the SID 16 and the BOP 19. The interaction of these elements will be described below.

The surface BOP 19 may be coupled to the drillship 10 via an adapter to the diverter housing 26. Additionally, a telescopic joint 28 may be employed to counteract movements from, for example, drillship 10 surge, sway, and heave. In some embodiments, an adapter 30 may be disposed between the BOP 19 and the telescopic joint 28 to allow for connection therebetween. Additionally, The BOP 19 may include a frame 32 having lifting points 33 that may be fastened to, for example, one or more riser tensioners to additionally allow for compensation of the motion of the drillship 10 relative to the wellbore to aid in keeping the BOP 19 stationary with respect to the seafloor 14.

The BOP may further house an annular preventer 34, which may consist of a large valve used to control wellbore fluids through mechanical squeezing of a sealing element about the drill pipe 12, as well as one or more RAM preventers 36, which may include a set of opposing rams that are designed to close within a bore (e.g., a center aperture region about drill pipe 20) of the BOP 19, for example, through hydraulic operation. Each of the ram preventers 36 may include cavities through which the respective opposing rams may pass into the bore of the BOP 19. These cavities may include, for example, shear ram cavities that house shear rams (e.g., hardened tool steel blades designed to cut/shear the drill pipe 20 then fully close to provide isolation or sealing of the drillship 10 from the wellbore 16). The ram preventers 36 may also include, for example, pipe ram cavities that house pipe rams (e.g., horizontally opposed sealing elements with a half-circle holes therein that mate to form a sealed aperture of a certain size through which drill pipe 20 passes) or variable bore rams (e.g., horizontally opposed sealing elements with a half-circle holes therein that mate to form a variably sized sealed aperture through which a wider range of drill pipes 20 may pass). The ram preventers 36 may be single-ram preventers (having one pair of opposing rams), double-ram preventers (having two pairs of opposing rams), triple-ram preventers (having three pairs of opposing rams), quad-ram ram preventers (having four pairs of opposing rams), or may include additional configurations.

The frame 32 of the BOP 19 may further house failsafe valves 38 as well as drape hosing 40. The failsafe valves 38 may include, for example, choke valves and kill valves that may be used to control the flow of well fluids being produced by circulating or isolating high pressure fluids passing through the conduits arranged laterally along the riser 12 to allow for control of the well pressure. The ram preventers 36 may include side outlets disposed in a vertical orientation that allow for the failsafe valves 38 to be coupled thereto. The drape hosing 40 may be one or more lines that connect to the choke valves and kill valves, for example, to connect the choke valves and kill valves to the choke manifold. In some embodiments, the BOP 19 may also be coupled to the riser string 12 (e.g., a low pressure riser string) via a mandrel adapter 42 that connects to a drilling adapter 44 of the BOP 19.

A tieback connector 22 (e.g., an upper tieback connector) may also be disposed adjacent to the mandrel adapter 42 (which may be a portion of the tieback connector 22) at a terminal end of the casing string 24. In this manner, the tieback connector 22 attaches to the bottom of the BOP 19, such that the tieback connector 22 is directly below the BOP 19 relative to the seafloor 14. In this manner, the tieback connector 22 provides a location from which the casing string 24 can be hung and supported. In some embodiments, a mandrel stress joint 46 (which may be part of the casing string 24 or coupled to a segment of the casing string 24 as an adapter) may be present to interface with the tieback connector 22. Indeed, as will be discussed in greater detail with respect to FIGS. 3-6, the mandrel stress joint 46 may be a terminating portion of the casing string 24 that allows for a interface (e.g., connection) with the tieback connector 22 and may include, for example, a matching profile for the tieback connector 22 for support of the casing string 24 and a polished surface for any sealing elements therein.

Additionally, in some embodiments, the casing string 24 may be run using conventional casing running tools. The casing string 24 may be handled using a casing tool 48, for example, to support the casing string 24 as it is being deployed. The casing tool 48 may also be used in conjunction with one or more of a top drive, a flush mounted spider, a fill and circulation tool, and a single joint elevator. The casing tool 48 may interface with the mandrel stress joint 46.

For example, the casing tool 48 may be run on drill pipe and may use mechanical dogs to engage a groove or other connection point of the mandrel stress joint 46.

As illustrated, the casing string 24 may be internal to (e.g., located within) the riser string 12. For example, the riser string 12 and the casing string 24 may be a set of concentric pipes extending between the SID 16 and the BOP 19 such that the riser string 12 has a diameter of approximately 20 in. or more and the casing string 24 has a diameter of approximately 14 in., 15 in., or 16 in. with a wall thickness of approximately 0.75 in., 1.0 in., 1.25 in., or more. These dimensions allow for the concentric placement of the casing string 24 concentrically within the riser string 12 such that the casing string 24 and the riser sting 24 run along a common distance along a vertical orientation between, for example, the SID 16 and the BOP 19, while maintaining sufficient structural integrity to withstand high pressure fluids from the wellbore.

Additionally illustrated are flex joints 50, which may be a steel and elastomer assembly having central through-passage equal to or greater in diameter than the riser string 12 bore. The flex joints 50 may be positioned in the riser string 12 to reduce local bending stresses. Additionally illustrated are riser joint adapters 52 that may allow for two segments of the riser string 12 to be mated, as well as a riser buoyancy unit 54 that provides upward force to reduce the weight of the riser string 12.

The casing string 24 may also be coupled to tieback connector 22 (e.g., a lower tieback connector) at another terminal end of the casing string 24. The casing tieback connector 22 may operate to seal around a mandrel stress joint 46 (which may be part of the casing string 24 or coupled to a segment of the casing string 24) to interface the casing string 24 with the tieback connector 22. As will be discussed in greater detail with respect to FIGS. 3-6, the casing tieback connector 22 may include a mechanism to recognize the location of mandrel stress joint 46 to facilitate the proper placement of any sealing element and/or locking dogs of the casing tieback connector 22 with the mandrel stress joint 46. The casing tieback connector 22 may be connected to the SID 16 or the casing tieback connector 22 may be internal to the SID 16 (e.g., above the one or more RAM preventers 36). Thus, in some embodiments, the tieback connector 22 may attach to the top of the SID 16, such that the tieback connector 22 is disposed directly above the SID 16 relative to the seafloor 14. Alternatively, the casing tieback connector 22 may be directly coupled to the wellhead 18 via a mandrel adapter 42 (which may be a portion of the tieback connector 22) and a wellhead connector (e.g., manually actuated connector 56).

As illustrated, the SID 16 includes a manually actuated connector 56 that may be coupled to the mandrel adapter 42. The manually actuated connector 56 may be coupled to SID connector 58 via another mandrel adapter 60 that is positioned via a passive re-entry system 62, the connection of which may be facilitated using hydraulic stab connections 64 to connect the manually actuated connector 56 to a SID frame 65. Additionally, in some embodiments, a SID recovering tool 66 made up of a drill pipe adapter 68 and a connector adapter 70 may additionally be utilized with the SID 16 to allow for faster retrieval of, for example, subsea components.

As illustrated, the SID 16 may also include ram preventers 36 and a drilling spool 72. The drilling spool 72 may be used to connect drill-through equipment with different end connections, nominal size designation, and/or pressure ratings to each other. The SID 16 may further include a connector 74 and a re-entry guide funnel 76 to allow the SID to be coupled to the wellhead 18. Additionally, the SID 16 may include a dead man (e.g., auto-shear) system 78 designed to automatically shut in the wellbore via the ram preventers 36 in the event of a simultaneous absence of hydraulic supply and control from the drillship 10. The SID 16 may further include an accumulator 80, which may be charged with gas (e.g., nitrogen) over liquid and used to store hydraulic fluid under pressure for operation of the SID 16. The SID 16 may also include one more remotely operated vehicle (ROV) panels that may be used to interface with an ROV, as well as hydraulic control pods 84 that may be ROV retrievable.

In operation, the SID 16 may be utilized to secure the well, for example, when the drillship 10 is to be disconnected from the wellhead 18. Thus, in some embodiments, a quick disconnect procedure (e.g., in times of inclement weather including hurricanes) may be implemented, in which the riser string 12 and the casing string 24 are removed from the SID 16 (e.g., at a disconnection point between SID connector 58 and mandrel adapter 60). For example, a lower marine riser package (LMRP) including flex joints 50, tieback connector 22, mandrel adapter 42, manually actuated connector 56, mandrel adapter 60, passive re-entry system 62, and hydraulic stab connections 64 may be removed while leaving the SID 16 behind. The SID 16 may seal the wellhead 18 until such time that the riser string 12 and the casing string 24 (along with the LMRP) can safely be redeployed from the drillship 10 to the SID 16.

Figure 3:
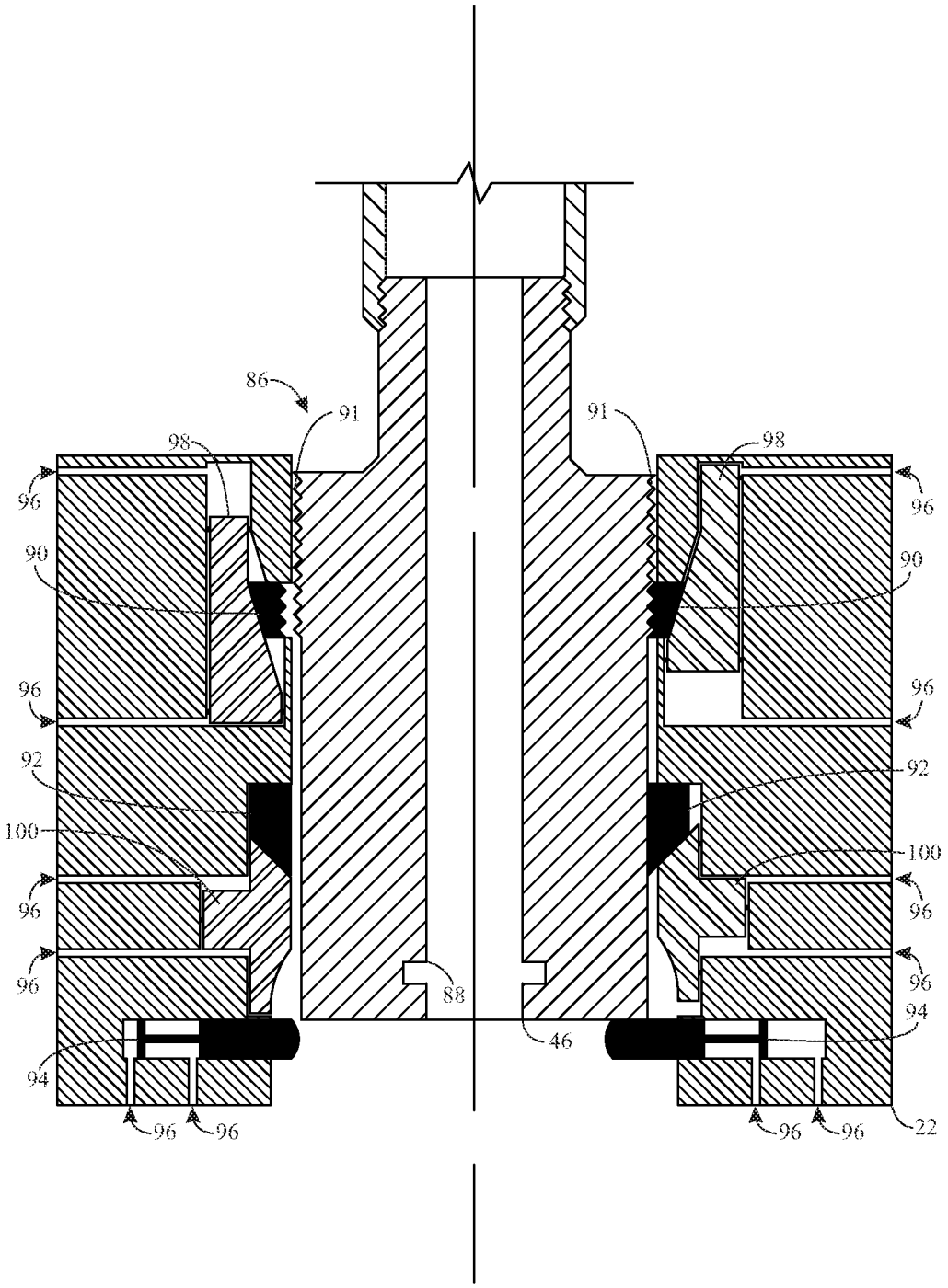
FIG. 3 illustrates a cross-sectional side view of an embodiment of the tieback connector illustrated in FIG. 2.

FIG. 3 illustrates a cross-sectional side view of an embodiment of the tieback connector 22. As illustrated, the tieback connector 22 may include a bore 86 (e.g., a center aperture region) through which the mandrel stress joint 46 may pass. The mandrel stress joint 46 may be handled using an aperture 88 (e.g., a groove) and, for example, a specialized running tool.

The tieback connector 22 may include a locking mechanism 90, such as one or more dog style locks or similar mechanisms, which may operate to fix the mandrel stress joint 46 to the tieback connector 22. The locking mechanism 90 of the tieback connector 22 and the mandrel stress joint 46 may each possess joints, appendages, teeth, or the like that mate with one another to ensure correct locking. In some embodiments, the mandrel stress joint 46 may include locking features 91 (e.g., teeth) that may interact with corresponding locking features of the locking mechanism 90 to ensure correct locking. Additionally, the locking features 91 may extend along the mandrel stress joint 46 for a distance along a vertical orientation greater than the distance along the vertical orientation of the locking features of the locking mechanism 90, such that if the mandrel stress joint 46 experiences stretch due to the weight of, for example, the casing string 24, the locking features 91 may still interact with the corresponding locking features of the locking mechanism 90.

Additionally, the locking mechanism 90 may be rated to support the entire weight of the casing string 24. To seal the inner bore pressure of the mandrel stress joint 46 from the annulus of the larger riser string 12, one or more sealing members 92, such as a spherical packer or similar mechanisms, may be utilized such that when a sealing member 92 constricts, the bore 86 is fluidly sealed. Furthermore, the tieback connector 22 may include one or more rods 94, such as location pins or similar mechanisms, to receive the mandrel stress joint 46 so that the proper location of the mandrel stress joint 46 inside of the tieback connector 22 can be confirmed. The one or more rods 94 may be useful in determining (e.g., recognizing or identifying) when locks (e.g., the locking mechanism 90 and/or the one or more sealing members 92) can be engaged and the one or more rods 94 may be useful in allowing for the general placement of tools and/or string.

In some embodiments, the tieback connector 22 may also include one or more ports 96. These ports 96 provide a hydraulic pressurized fluid that interacts with support member 98, the one or more sealing members 92, and the one or more rods 94. For example, through hydraulic pressurized fluid provided from the respective ports 96 adjacent the locking mechanism 90, support member 98 may be moved from a first position in which the locking mechanism 90 is not in contact with the mandrel stress joint 46, as illustrated in the left half of the illustrated tieback connector 22, to a second position in which the locking mechanism 90 is in contact with the mandrel stress joint 46, as illustrated in the right half of the illustrated tieback connector 22.

Additionally, through hydraulic pressurized fluid provided from the respective ports 96 adjacent the one or more sealing members 92, support member 100 may be moved from a first position in which a sealing member 92 is not in contact with the mandrel stress joint 46, as illustrated in the left half of the illustrated tieback connector 22, to a second position in which the sealing member 92 is in contact with the mandrel stress joint 46, as illustrated in the right half of the illustrated tieback connector 22. Likewise, through hydraulic pressurized fluid provided from the respective ports 96 adjacent the one or more rods 94, a rod 94 may be moved from a first position in which the rod 94 is not in contact with the mandrel stress joint 46, as illustrated in the left half of the illustrated tieback connector 22, to a second position in which the rod 94 is in contact with the mandrel stress joint 46, as illustrated in the right half of the illustrated tieback connector 22.

By separating the locking mechanism 90 from the one or more sealing members 92 so that locking mechanism 90 and the one or more sealing members 92 are physically separate (e.g., independently disposed along a vertical orientation), wear on the one or more sealing mechanisms 92 may be reduced. For example, forces along the vertical orientation of the tieback connector 22 may be resisted through allowing greater locking pressure on the mandrel stress joint 46 by the locking mechanism 90 relative to the sealing pressure applied by the one or more sealing members 92. This can operate to reduce wear on the one or more sealing members 92 that might otherwise occur if the one or more sealing members 92 were also operating as a locking mechanism of the tieback connector 22.

The hydraulic pressurized fluid, discussed above as being applied from ports 96, may be controlled via a controller of the SID 16 or the BOP 19, depending on the location of the tieback connector 22. Thus, when the tieback connector 22 is adjacent the SID 16, a controller of the SID 16 may control the hydraulic pressures applied via ports 96. Conversely, when the tieback connector 22 is adjacent the BOP 19, a controller of the BOP 19 may control the hydraulic pressures applied from ports 96. The controller may be a hydraulic and/or an electrical controller.

Figure 4:
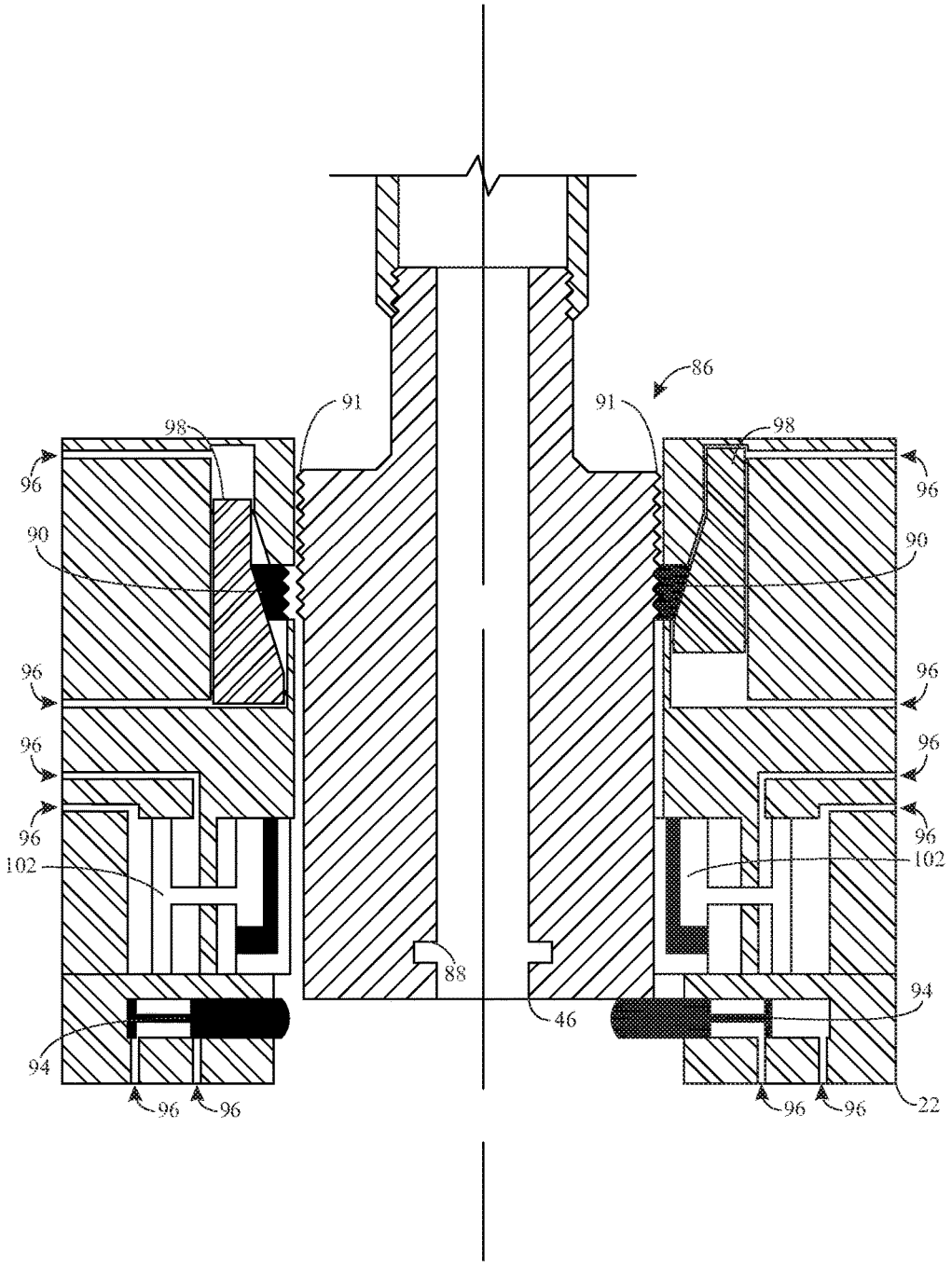
FIG. 4 illustrates a cross-sectional side view of a second embodiment of the tieback connector illustrated in FIG. 2.

FIG. 4 illustrates a cross-sectional side view of a second embodiment of the tieback connector 22. As illustrated, the tieback connector 22 includes a bore 86 through which the mandrel stress joint 46 may pass. The tieback connector 22 may also include a locking mechanism 90 and one or more rods 94 that may each be activated via control of hydraulic fluids passing through respective ports 96, as discussed above with respect to FIG. 3. Additionally, the illustrated tieback connector 22 may utilize a sealing mechanism 102, such as a ram packer which constricts when a piston is horizontally stroked, or a similar mechanism. The sealing mechanism 102 may be moved into and out of contact with the mandrel stress joint 46 through application of hydraulic pressures. For example, through hydraulic pressurized fluid provided from the respective ports 96 adjacent the sealing mechanism 102, the sealing mechanism 102 may be moved from a first position in which the sealing mechanism 102 is not in contact with the mandrel stress joint 46, as illustrated in the tieback connector 22 of FIG. 4, to a second position in which the sealing mechanism 102 is in contact with the mandrel stress joint 46 (not illustrated). The hydraulic pressure being applied from ports 96 may be controlled via a controller of the SID 16 or the BOP 19, depending on the location of the tieback connector 22. Thus, when the tieback connector 22 is adjacent the SID 16, a controller of the SID 16 may control the hydraulic pressures applied from ports 96. Conversely, when the tieback connector 22 is adjacent the BOP 19, a controller of the BOP 19 may control the hydraulic pressures applied via ports 96. Moreover, the controller may be a hydraulic and/or an electrical controller.

By separating the locking mechanism 90 from the sealing mechanism 102 so that locking mechanism 90 and the sealing mechanism 102 are physically separate (e.g., independently disposed along a vertical orientation), wear on the sealing mechanism 102 may be reduced. For example, forces along the vertical orientation of the tieback connector 22 may be resisted through allowing greater locking pressure on the mandrel stress joint 46 by the locking mechanism 90 relative to the sealing pressure applied by the sealing mechanism 102. This can operate to reduce wear on the sealing mechanism 102 that might otherwise occur if the sealing mechanism 102 were also operating as a locking mechanism of the tieback connector 22.

Figure 5:
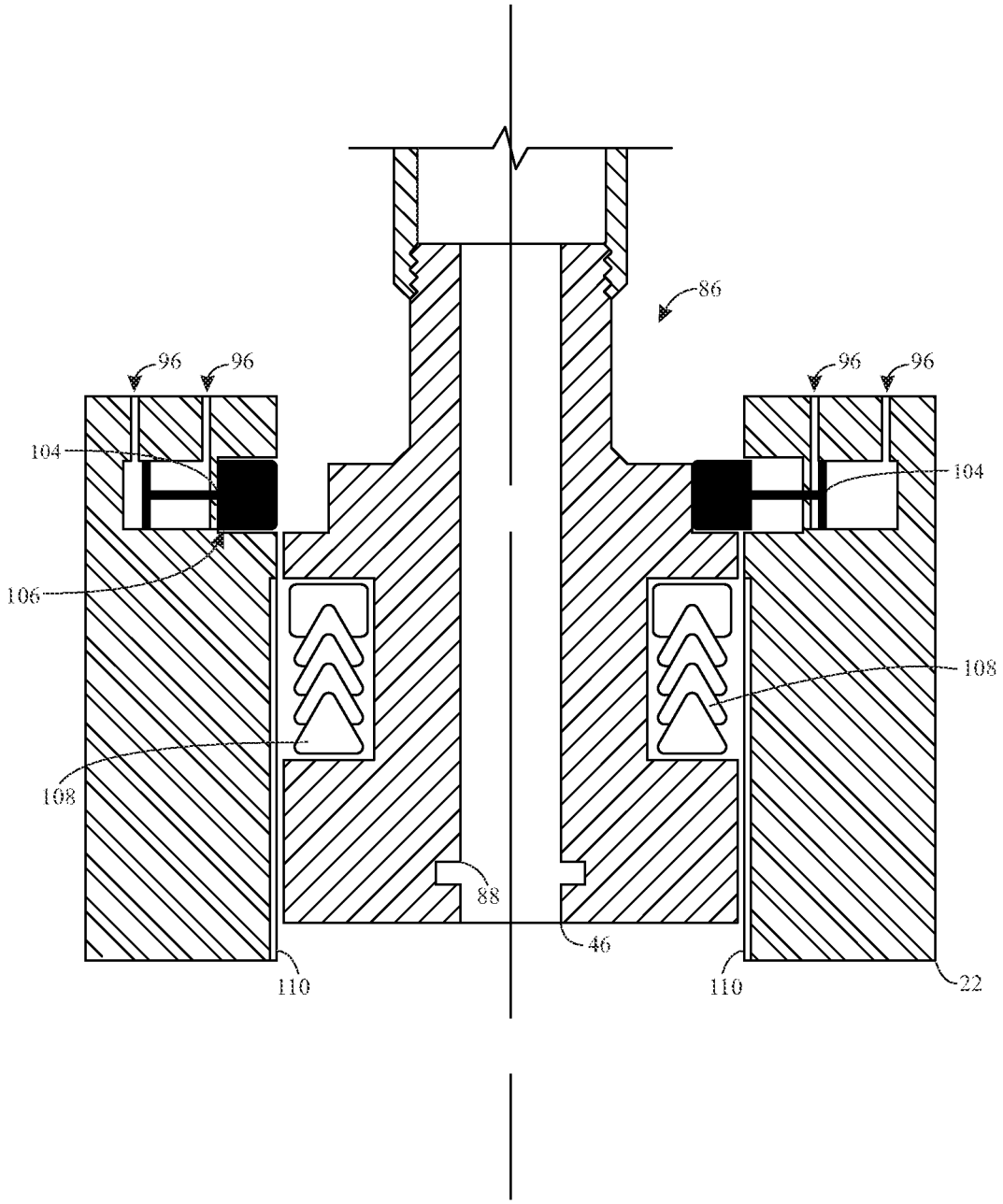
FIG. 5 illustrates a cross-sectional side view of a third embodiment of the tieback connector illustrated in FIG. 2.

FIG. 5 illustrates a cross-sectional side view of a third embodiment of the tieback connector 22. As illustrated, the tieback connector 22 includes a bore 86 through which the mandrel stress joint 46 may pass. The tieback connector 22 may also include a locking mechanism 104, such as one or more dog style indicator pins (e.g., dogs) or similar mechanisms, which may operate to fix the mandrel stress joint 46 to the tieback connector 22. The locking mechanism 104 may be useful in determining (e.g., recognizing or identifying) the position of the mandrel stress joint 46. The locking mechanism 104 can be engaged and, thus, may be useful in allowing for the general placement of tools and/or string. The locking mechanism 104 may also provide support in one direction, for instance, to support a casing string 24 which is under tension. Additionally, present in the tieback connector 22 is an aperture 106, such as a mud channel, which allows, for example, mud to travel around the locking mechanism 104 and equalize pressure.

Through hydraulic pressurized fluid provided from the respective ports 96 adjacent the locking mechanism 104, locking mechanism 104 may be moved from a first position in which the locking mechanism 104 is not in contact with the mandrel stress joint 46, as illustrated in the left half of the illustrated tieback connector 22, to a second position in which the locking mechanism 104 is in contact with the mandrel stress joint 46, as illustrated in the right half of the illustrated tieback connector 22. The hydraulic pressure being applied from ports 96 may be controlled via a controller of the SID 16 or the BOP 19, depending on the location of the tieback connector 22. Thus, when the tieback connector 22 is adjacent the SID 16, a controller of the SID 16 may control the hydraulic pressures applied from ports 96. Conversely, when the tieback connector 22 is adjacent the BOP 19, a controller of the BOP 19 may control the hydraulic pressures applied from ports 96. Furthermore, the controller may be a hydraulic and/or an electrical controller.

Additionally, the illustrated tieback connector 22 may utilize a sealing mechanism 108, such as a set of chevron seals or lip seals and a plate 110 (or a similar mechanism), to create a sealing arrangement. Thus, the sealing mechanism 108 may be a plurality of sealing elements that deform when pressures are applied thereto to contact the plate 110 to form a seal. Additionally, the plate 110 may be a smooth and/or polished surface. For example, the plate 110, may be formed from a hard faced corrosion resistant alloy which can maintain its surface finish in the presence of well fluids, such as but not exclusive to $H_2S$, well cuttings, xylene, methanol, etc.

By separating the locking mechanism 104 from the sealing mechanism 108 so that locking mechanism 104 and the sealing mechanism 108 are physically separate (e.g., independently disposed along a vertical orientation), wear on the sealing mechanism 108 may be reduced. For example, forces along the vertical orientation of the tieback connector 22 may be resisted through allowing greater locking pressure on the mandrel stress joint 46 by the locking mechanism 104 relative to the sealing pressure applied by the sealing mechanism 108. This can operate to reduce wear on the sealing mechanism 108 that might otherwise occur if the sealing mechanism 108 were also operating as a locking mechanism of the tieback connector 22.

Figure 6:
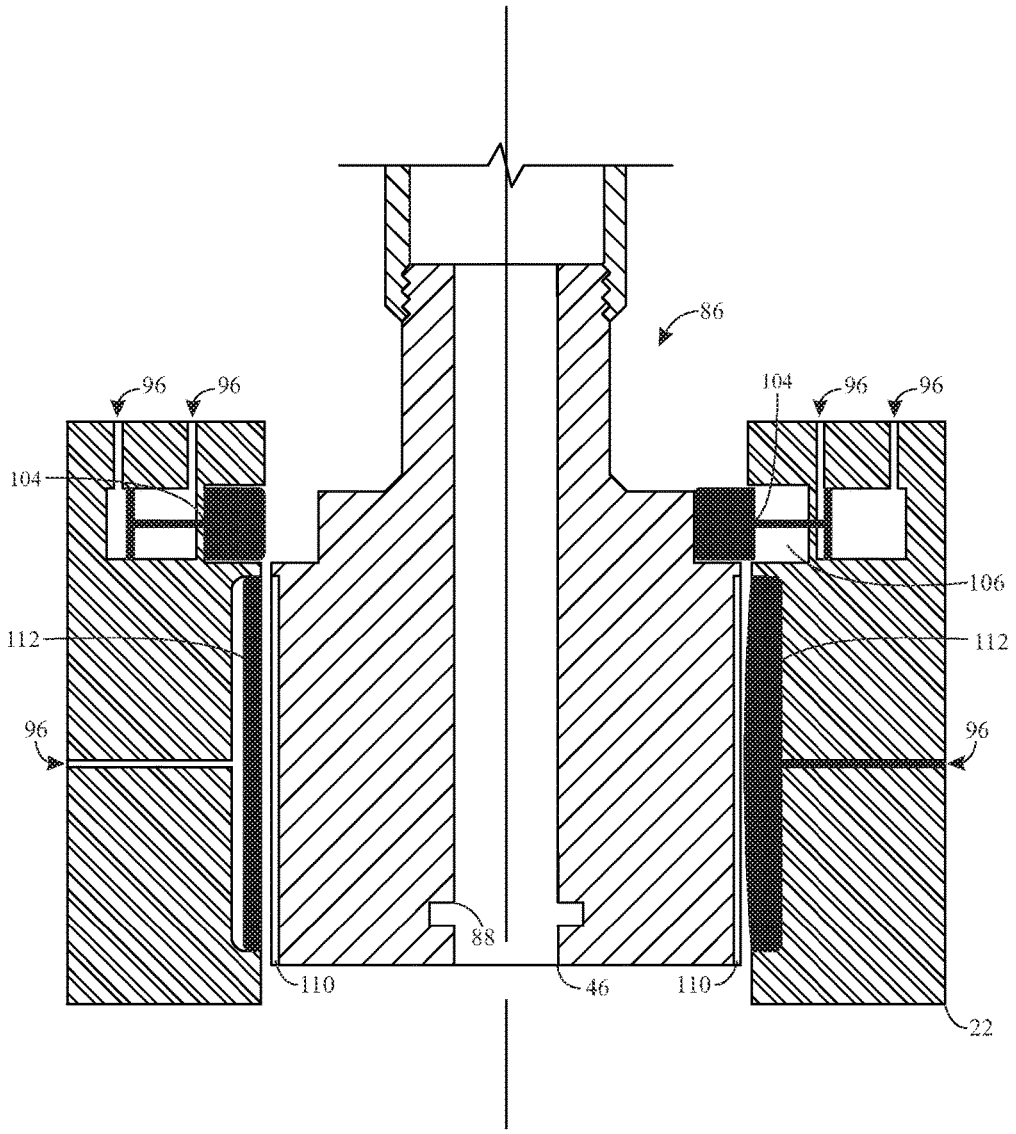
FIG. 6 illustrates a cross-sectional side view of a fourth embodiment of the tieback connector illustrated in FIG. 2.

FIG. 6 illustrates a cross-sectional side view of a fourth embodiment of the tieback connector 22. As illustrated, the tieback connector 22 includes a bore 86 through which the mandrel stress joint 46 may pass. The tieback connector 22 may also include a locking mechanism 104 that may be activated via control of hydraulic fluids passing through respective ports 96, as discussed above with respect to FIG. 5, as well as an aperture 106, such as a mud channel, which allows, for example, mud to travel around the locking mechanism 104 and equalize pressure.

Additionally, the illustrated tieback connector 22 may utilize a sealing mechanism 112, such as one or more a hydraulic packers and a plate 110 (or a similar mechanism), to create a sealing arrangement. The sealing mechanism 112 may be a ring of compliant material that deforms (e.g., flexes) and seals against the plate 110 when pressure is applied. This pressure may be hydraulic pressure being applied via ports 96 and may be controlled via a controller of the SID 16 or the BOP 19, depending on the location of the tieback connector 22. Thus, when the tieback connector 22 is adjacent the SID 16, a controller of the SID 16 may control the hydraulic pressures applied from ports 96. Conversely, when the tieback connector 22 is adjacent the BOP 19, a controller of the BOP 19 may control the hydraulic pressures applied from ports 96. The controller may be a hydraulic and/or an electrical controller. Additionally, similar to FIG. 5, the plate 110 may be a smooth and/or polished surface that may, for example, be formed from a hard faced corrosion resistant alloy which can maintain its surface finish in the presence of well fluids, such as but not exclusive to $H_2S$, well cuttings, xylene, methanol, etc.

By separating the locking mechanism 104 from the sealing mechanism 112 so that locking mechanism 104 and the sealing mechanism 112 are physically separate (e.g., independently disposed along a vertical orientation), wear on the sealing mechanism 112 may be reduced. For example, forces along the vertical orientation of the tieback connector 22 may be resisted through allowing greater locking pressure on the mandrel stress joint 46 by the locking mechanism 104 relative to the sealing pressure applied by the sealing mechanism 112. This can operate to reduce wear on the sealing mechanism 112 that might otherwise occur if the sealing mechanism 112 were also operating as a locking mechanism of the tieback connector 22.

The proposed layout in FIG. 2 can employ any of the tieback connectors 22 in FIGS. 3-6 as an upper tieback connector or as a lower tieback connector. For example, the tieback connector 22 of FIGS. 3 and 4 may be utilized as an upper tieback connector (e.g., directly adjacent the BOP 19) because the tieback connectors 22 of FIGS. 3 and 4 may provide a mechanism to hang the inner casing string (due, at least in part to the inclusion of positive locking segments in locking mechanism 90). Similarly, for example, the tieback connector 22 of FIGS. 5 and 6 may be utilized as a lower tieback connector (e.g., directly adjacent the SID 16) to reduce the logistics involved at least because the plate 110 of the tieback connectors 22 of FIGS. 5 and 6 can be increased to accommodate a large space out error. Accordingly, by employing different types of tieback connectors 22, the feasibility of increasing the internal pressure rating of the riser string 12 (when viewed as a including casing string 24) can be achieved while avoiding the retrieval of any previously deployed equipment (e.g., a standalone riser string 12).

Additionally, it may be appreciated that during a disconnect procedure for the casing string 24, the sequencing of locking and unlocking the casing string 24 may include disengaging locking mechanisms and sealing mechanisms of the tieback connector 22 (e.g., the locking mechanism 90, the one or more sealing members 92, the sealing mechanism 102, the locking mechanism 104, the sealing mechanism 108, and/or the sealing mechanism 112, depending on the tieback connector 22 utilized). Once the locking mechanisms and sealing mechanisms of the particular tieback connector 22 are actuated (e.g., opened), any additional locking mechanisms of the casing string 24 may be disengaged to for the casing string 24 to be disconnected and removed to the surface.

Additionally, a reverse process may be undertaken to connect the riser string 12 and the casing string 24 to a SID 16. For example, once additional locking mechanisms of the riser string 24 are engaged (e.g., locked), locking mechanisms and sealing mechanisms of the tieback connector 22 (e.g., the locking mechanism 90, the one or more sealing members 92, the sealing mechanism 102, the locking mechanism 104, the sealing mechanism 108, and/or the sealing mechanism 112, depending on the tieback connector 22 utilized) may be engaged (e.g., closed) to couple the casing string 24 to any relevant tieback connector 22 and, thus, the SID 16.

Figure 7:
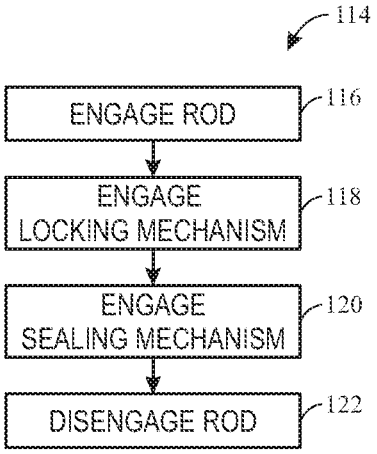
FIG. 7 illustrates a flow chart of a first embodiment of connecting the tieback connector illustrated in FIG. 2.
Figure 8:
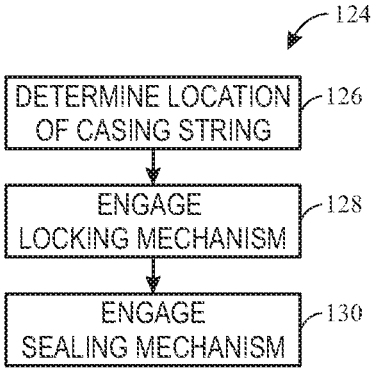
FIG. 8 illustrates a flow chart of a second embodiment of connecting the tieback connector illustrated in FIG. 2.

FIG. 7 illustrates an example of a flow chart 114 describing a process for connecting the casing string 24 to a tieback connector 22 (e.g., a mandrel stress joint 46 of the casing string 24). In step 116, one or more rods 94 may be engaged to provide a stop point for the mandrel stress joint 46. Once the mandrel stress joint 46 contacts the one or more rods 94, the locking mechanism 90 may engage the mandrel stress joint 46 in step 118. In step 120, a sealing mechanism (e.g., the one or more sealing members 92 or the sealing mechanism 102) may be engaged to provide a seal and in step 122, the one or more rods 94 may be disengaged. Similarly, FIG. 8 illustrates an example of a flow chart 124 describing a process for connecting the casing string 24 to a tieback connector 22 (e.g., a mandrel stress joint 46 of the casing string 24).

In step 126, the location of the casing string 24 (and/or mandrel stress joint 46) may be determined. This determination may be made through, for example, monitoring of the number of pipe segments 25 used in the casing string 24. Once the location (along a vertical orientation) has been determined, the locking mechanisms 104 may be engaged in step 128. In step 130, a sealing mechanism (e.g., the sealing mechanism 108 or the sealing mechanism 112) may be engaged to provide a seal in the tieback connector 22. Additionally, a reverse process to that outlined above in flow charts 114 and 124 may be undertaken to disconnect the casing string 24 (e.g., a mandrel stress joint 46 of the casing string 24) from a tieback connector 22.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A device, comprising a tieback connector comprising:

a locking mechanism configured to physically mate with a single terminal end of a casing string configured to be co-located within a riser string of an offshore platform, wherein the physical mating of the locking mechanism with the a single terminal end of a casing string directly couples the tieback connector to the single terminal end of the casing string when the locking mechanism is engaged; and a sealing mechanism configured to contact the single terminal end of the casing string to fluidly seal an area around the single terminal end of the casing string, wherein the locking mechanism and the sealing mechanism are disposed at separate positions along a vertical orientation of the tieback connector.

2. The device of claim 1, wherein the locking mechanism comprises first locking features configured to interact with second locking features of the single terminal end of the casing string.

3. The device of claim 1, comprising a rod configured to engage into a first position in a central aperture region of the tieback connector to contact the single terminal end of the casing string.

4. The device of claim 3, wherein the rod is configured to disengage from the central aperture region of the tieback connector and to a second position within the tieback connector.

5. The device of claim 1, wherein the locking mechanism is disposed above the sealing mechanism along the vertical orientation of the tieback connector.

6. The device of claim 1, comprising a port configured to receive a hydraulic pressurized fluid.

7. The device of claim 6, comprising a path coupling the port to the locking mechanism, wherein the path flows the hydraulic pressurized fluid from the port to the locking mechanism to move the locking mechanism from a first position to a second position.

8. The device of claim 6, comprising a path coupling the port to the sealing mechanism, wherein the path flows the hydraulic pressurized fluid from the port to the sealing mechanism to move the sealing mechanism from a first position to a second position.

9. The device of claim 6, comprising:

a rod configured to engage into a first position in a central aperture region of the tieback connector to contact the single terminal end of the casing string; and a path coupling the port to the rod, wherein the path flows the hydraulic pressurized fluid from the port to the rod to engage the rod into the first position.

10. The device of claim 1, wherein the locking mechanism is configured to apply tension to an inner string of the casing string or allow the inner string to hang freely along the vertical orientation of the tieback connector.

11. A system, comprising:

a casing string configured to be disposed within a riser string and comprising a single terminal end; and a tieback connector configured to be coupled to the single terminal end of the casing string, wherein the tieback connector comprises:

a locking mechanism configured to physically mate with the single terminal end of the casing string, wherein the physical mating of the locking mechanism with the a single terminal end of a casing string directly couples the tieback connector to the single terminal end of the casing string when the locking mechanism is engaged; and a sealing mechanism configured to contact the single terminal end of the casing string to fluidly seal an area around the single terminal end of the casing string, wherein the locking mechanism and the sealing mechanism are disposed at separate positions along a vertical orientation of the tieback connector.

12. The system of claim 11, wherein casing string comprises a plurality of pipe segments, wherein the single terminal end of the casing string comprises an adapter coupled to at least one pipe segment of the plurality of segments.

13. The system of claim 11, wherein the locking mechanism comprises first locking features, wherein the single terminal end of the casing string comprises second locking features configured to interact with the first locking features.

14. The system of claim 13, wherein the second locking features extend for a first distance along the vertical orientation of the tieback connector that is greater than a second distance at which the first locking features extend along the vertical orientation of the tieback connector.

15. The system of claim 11, wherein the tieback connector comprises a rod configured to engage into a first position in a central aperture region of the tieback connector to contact the single terminal end of the casing string with the rod.

16. The system of claim 11, wherein the sealing mechanism comprises a hydraulic packer, and wherein the single terminal end of the casing string comprises a plate configured to engage with the hydraulic packer to form a fluid seal.

17. The system of claim 11, wherein the single terminal end of the casing string comprises a chevron seal or a lip seal, and wherein the sealing mechanism comprises a plate configured to engage with the chevron seal or the lip seal to form a fluid seal.

18. The system of claim 11, comprising a second tieback connector disposed at a second terminal end of the casing string.

19. The system of claim 18, comprising a surface blowout preventer coupled to the second tieback connector.

20. A method, comprising:

engaging a locking mechanism of a tieback connector to physically mate the locking mechanism with a single terminal end of a casing string internal to a riser to directly couple the tieback connector to the single terminal end of the casing string when the locking mechanism is engaged; and engaging a sealing mechanism of the tieback connector to contact the single terminal end of the casing string to fluidly seal an area around the single terminal end of the casing string, wherein the locking mechanism and the sealing mechanism are disposed at separate positions along a vertical orientation of the tieback connector.

21. The method of claim 20, comprising engaging a rod of the tieback connector in a first position in a central aperture region of the tieback connector to engage the single terminal end of the casing string with the rod.

* * * * *